United States Patent [19]

Dickinson

[11] 4,380,851

[45] * Apr. 26, 1983

[54] ROLLER BURNISHING TOOL

[76] Inventor: Lawrence C. Dickinson, 2255 Eva Adams, Reno, Nev. 89504

[ * ] Notice: The portion of the term of this patent subsequent to Jan. 11, 2000, has been disclaimed.

[21] Appl. No.: 205,026

[22] Filed: Nov. 7, 1980

Related U.S. Application Data

[63] Continuation-in-part of Ser. No. 183,664, Sep. 2, 1980.

[51] Int. Cl.[3] ..... B24B 39/00; B24B 39/02

[52] U.S. Cl. ..... 29/90 R; 72/123

[58] Field of Search ..... 29/90 R; 407/1; 408/22, 408/130; 72/122, 123, 125

[56] References Cited

U.S. PATENT DOCUMENTS

| | | | |
|---|---|---|---|
| 3,656,333 | 4/1972 | Kruse | 72/122 |
| 3,736,633 | 6/1973 | Kalen | 72/122 |
| 3,791,000 | 2/1974 | Kunze | 29/90 R |
| 3,795,957 | 3/1974 | Steusloff | 407/1 |
| 3,980,442 | 9/1976 | Riekeles | 407/1 |
| 4,133,089 | 1/1976 | Heymanns | 29/90 R |

*Primary Examiner*—William R. Briggs
*Assistant Examiner*—Jerry Kearns
*Attorney, Agent, or Firm*—Townsend and Townsend

[57] ABSTRACT

A roller burnishing tool for finishing the internal surface of a cylindrical hole is disclosed. The tool includes a roller race having a central axis and a frustoconical outer surface tapering radially outward and axially forward. A plurality of frustoconically tapered rollers are arranged about the outer surface for rolling engagement with the outer surface with the smaller ends of the rollers facing forward. The taper of the rollers is such that the outermost surface portion of each roller is parallel to the central axis. The rollers are biased in the forward direction with a chosen force so that the force exerted on the internal surface of the hole remains constant over a range of sizes of the hole.

11 Claims, 2 Drawing Figures

ROLLER BURNISHING TOOL

This application is a continuation-in-part of U.S. patent application Ser. No. 183,664 filed Sept. 2, 1980, titled "Skiving and Roller Burnishing Tool".

BACKGROUND OF THE INVENTION

The present invention relates to roller burnishing tools for smoothing the interior surface of a cylindrical hole.

Roller burnishing tools utilize a plurality of circumferentially spaced rollers in a roller cage to roller burnish the interior of a pre-formed cylindrical hole so that it has a smooth finish. Tools of this type are available in which the rollers are located on a race which is inclined radially outwardly toward the rear, and a manually adjustable stop is provided which restricts the rearward movement of the rollers up the inclined race. Tools utilizing roller burnishers of this type are illustrated in a brochure of the Hegenscheidt Corporation, having a U.S. office at 1070 Livernois Ave., Troy, Mich. 48084 entitled The Combined Skiving and Roller Finishing Tools, Type RDS RETRAC, and U.S. Pat. Nos. 3,795,957 and 4,133,089.

When roller burnishing tools of the type described above are inserted in a cylinder, the forward thrust of the tool causes the rollers to move upwardly along the inclined race until the race contacts the preset stop. Accordingly, for all practical purposes, the rollers have a preset radius depending on the position of the stop.

If the diameter of the interior of a cylinder is very close to its nominal diameter, the roller burnishing operation will typically proceed quite smoothly. However, if the diameter of the cut cylinder is slightly oversized, the interior surfaces of the cylinder may not be sufficiently burnished. If the diameter is somewhat smaller than nominal, caused by cutting tool wear or other variables, the effective fixed diameter of the rollers will cause excessive working of the interior surfaces of the cylinder, requiring large forces to drive the tool through the cylinder, and often resulting in jamming of the tool inside the cylinder. If jamming does occur, the tool often cannot be retrieved intact, resulting in destruction of an extremely expensive working tool.

The roller burnishing tool, which is often found in combination with a skiving tool, is typically inserted into the cylinder through a drawtube to align it with the interior of the cylinder. The drawtube has the same or nearly the same diameter as the cylinder, and the roller burnishing tool as described above will roller burnish the drawtube on each cycle. Eventually, the drawtube becomes oversized, and the diameter of the drawtube does not accurately match that of the cylinder. When the roller cage reaches the preset stop further outward movement of the roller is prevented, and the drawtube will not accurately align the tool with the cylinder.

The roller burnishing tools described above typically have nylon pads to stabilize the roller burnishing action of the tool. These nylon pads tend to wear with use, and when worn, often cause chattering of the tool, which ruins the cylinder finish. In addition, if the nylon pads are worn, the rollers may contact the interior surface of the cylinder when the tool is withdrawn and score the interior surface so that it is unusable.

SUMMARY OF THE INVENTION

The present invention provides a roller burnishing tool for finishing the internal surface of a cylindrical hole by passing the tool through the hole in a forward direction. The tool includes a roller race having a central axis and a frustoconical outer surface tapering radially outward and axially forward. A plurality of frustoconically tapered rollers are arranged about the outer surface for rolling engagement with the outer surface with the smaller ends of the rollers facing forward. The taper of the rollers is such that the outermost surface portion of each roller is parallel to the central axis. The rollers are biased in the forward direction with a chosen force so that the force exerted on the internal surface of the hole remains constant over a range of sizes of the hole.

In the apparatus of the present invention, the roller race tapers outwardly in a forward direction, rather than outwardly in a rearward direction as in known devices. As a result, forward movement of the tool does not press the rollers against the preset stop, but rather the rollers move backwardly until restrained by the selected axial force. As a result, the rollers will apply an equal burnishing force to the interior of the cylinder through a range of diameters. The rollers of the present invention automatically adjust to the diameter of the workpiece, and will not overwork the piece or become jammed inside.

The automatic adjustment features of the rollers of the present invention also facilitate the transfer of the tool from the drawtube to the cylinder. The rollers are actuated and forced outwardly while the roller burnishing portion of the tool is still in the drawtube to stabilize the initial action of the cutter blade. When the rollers themselves move from the drawtube to the cylinder, they will automatically adjust to any change in diameter.

The roller burnishing tool of the present invention is self-stabilizing as a result of the balanced forces provided by the rollers. Nylon pads are not used to stabilize the tool when the tool makes it working pass through the cylinder. Nylon pads are provided, however, which only contact the interior surface of the cylinder when the rollers have been retracted and the tool is being withdrawn. These nylon pads prevent the rollers from contacting the interior surface of the cylinder when the tool is being withdrawn which would destroy the quality of the surface.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
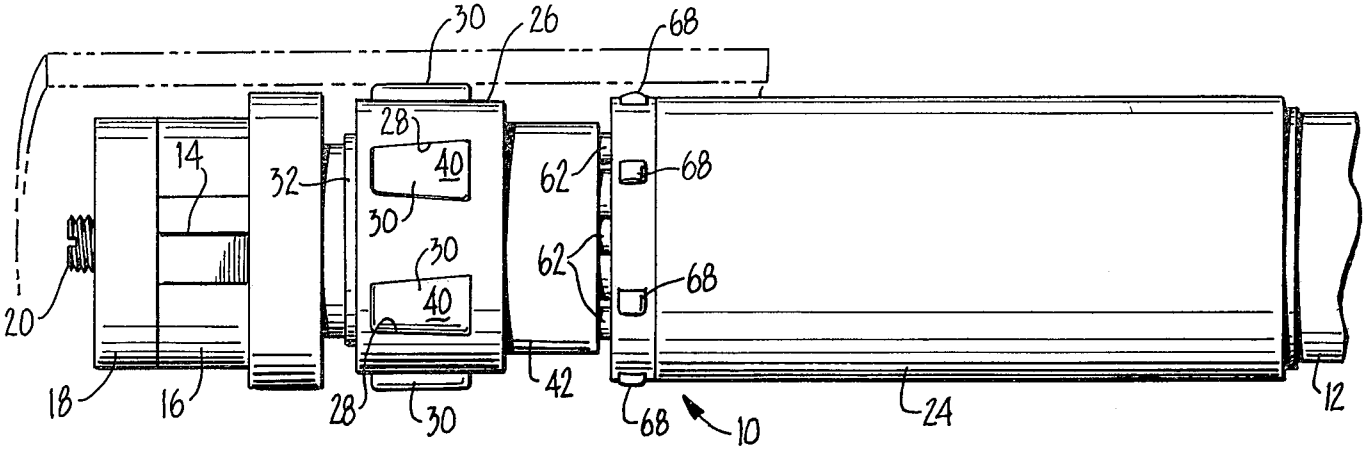
FIG. 1 is a side elevation view of the preferred embodiment of the skiving and roller burnishing tool of the present invention.
Figure 2:
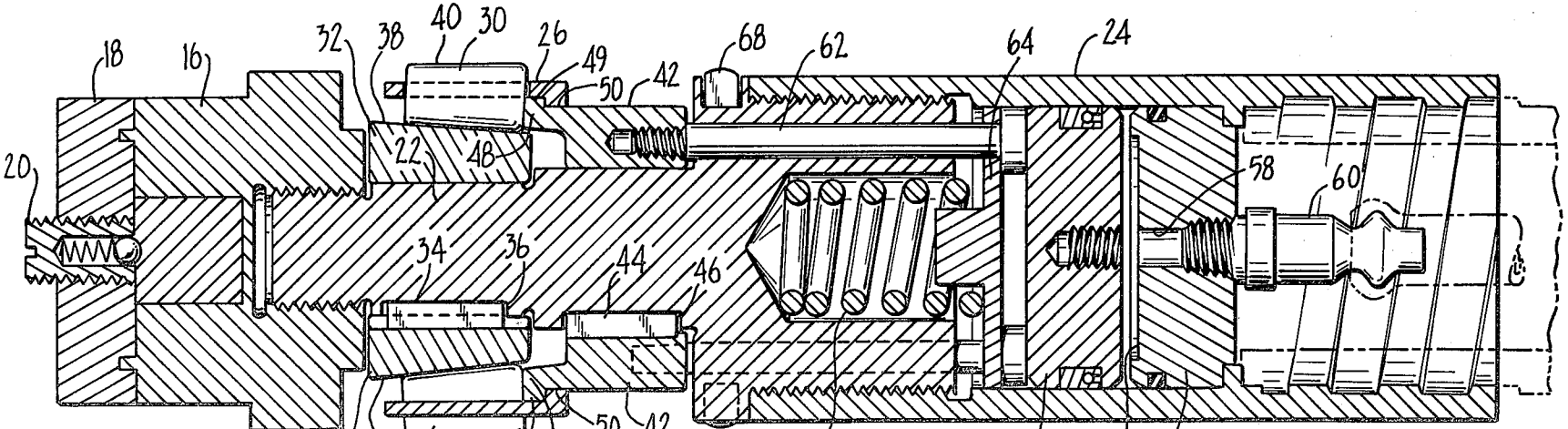
FIG. 2 is a sectional elevation view of the tool of FIG. 1.

The preferred embodiment 10 of the roller burnishing tool of the present invention is illustrated generally by way of reference to FIGS. 1 and 2 in combination. Tool 10 is mounted to the forward end of a drive member 12 which propels the tool through the interior of a cylinder or other workpiece. Most often, the tool 10 of the present invention is used to finish the interior surfaces of a large hydraulic or pneumatic cylinder.

The embodiment of tool 10 illustrated includes a skiving or cutter blade 14 mounted in a blade holder 16. A cutter cap 18 secures the cutter blade 14 to holder 16, and a spring plunger 20 holds the cutter blade in position.

As illustrated in FIG. 2, cutter blade holder 16 is welded or otherwise fixed to the leading end of a drive shaft 22, which is in turn welded or otherwise fixed to a cylindrical drive tube 24. Drive tube 24 is fixed to the leading end of drive member 12, and accordingly, cutting blade holder 16 is directly coupled to the drive member to drive cutting blade 14 through the cylinder.

A roller cage 26 circumscribes drive shaft 22 aft of cutter blade holder 16. Roller cage 26 has a plurality of apertures 28, accommodating a corresponding plurality of rollers 30. The apertures 28 in race 26 restrict the movement of rollers 30, while allowing the rollers to rotate and translate to a limited degree in a radial direction, as will be described in more detail hereinafter.

A roller race 32 circumscribes drive shaft 22 beneath roller cage 26. Race 32 has a key 34 engaging a corresponding slot 36 in drive shaft 22 so that the roller race is nonrotatable relative to the drive shaft.

Roller race 32 has an inclined outer surface 38 which is frustoconical in section. Surface 28 tapers outwardly in a forward direction. Rollers 30 are also frustoconical in section and have sufficient taper so that the rollers, bearing on surface 38 of race 32, are aligned so that their outer surfaces 40 are parallel to the axis of drive shaft 22.

A roller pusher 42 circumscribes drive shaft 22, and also has a key 44 engaging a corresponding slot 46 in drive shaft 22 so that the roller pusher is nonrotatable relative to the drive shaft. Roller pusher 42 has a forward extension 48 which bears against the rear surfaces of rollers 30 so that the roller pusher can apply a forward force directly to the rollers. In addition, the forward extension 48 of roller pusher 42 has a lip 49 engaging a corresponding lip 50 on roller cage 26 so that aft movement of the roller pusher will draw the roller cage rearwardly.

A hydraulic (or possibly pneumatic) piston 52 is located in the interior of drive tube 24. A corresponding plug 54 is also located in drive tube 24 to define a cavity 56 between the plug and piston 52. A bore 58 in plug 54 communicates with a hydraulic or pneumatic fitting 60 which couples to a source of hydraulic or pneumatic fluid (not shown) within the drive member 12.

A plurality of dowel pins such as 62 emanate from the forward surface of piston 52. Dowel pins 62 threadably engage the roller pusher 42, and a dowel retainer 64 secures the ends of dowel pins 62 near piston 52. A coil spring 66 biases dowel retainer 64 rearwardly so that dowel pins 62 are maintained in contact with the forward surface of piston 52.

Actuation of piston 52 by supplying a fluid through fitting 60 applies a forward force to dowel pin 62 which is transmitted through roller pusher 42 to rollers 30. This force moves rollers 30 up the inclined surface 38 of roller race 32 until the applied force is balanced by the force of the rollers against the interior workpiece.

It is readily apparent that rollers 30 will adapt themselves to the actual diameter of the interior of the cylinder, and will apply an equal force throughout a range of diameters depending upon the force applied to piston 52. Moreover, if the interior of the cylinder is undersized, the rollers will merely move a lesser distance up inclined surface 38, and there will be no tendency for the tool to jam in the workpiece. In addition, the fact that dowel pins 62 are not rigidly connected to piston 52 assures that an equal force is applied to all rollers 30, and the system is selfstabilizing and does not require an independent stabilizing mechanism such as nylon pads.

A plurality of nylon pads 68 are provided about the outer circumference of tool 10. Nylon pads 68 have a lesser diameter than rollers 30 when the rollers are actuated so that the nylon pads do not contact the interior of the cylinder while roller burnishing is taking place. However, when tool 10 is retracted, piston 52 is deactuated, spring 66 biases it to its closed position, and roller cage 26 is drawn rearwardly to retract the rollers. In this configuration, nylon pads 16 have a greater diameter than rollers 30, and the tool will slide smoothly out of the interior of the cylinder on pads 68 and will not score the surface.

While a preferred embodiment of the present invention has been illustrated in detail, it is apparent that modifications and adaptations of that embodiment will occur to those skilled in the art. However, it is to be expressly understood that such modifications and adaptations are within the spirit and scope of the present invention, as set forth in the following claims.

What is claimed is:

1. A roller burnishing tool for finishing the internal surface of a cylindrical hole by passing said tool through said hole, comprising:

an elongate drive shaft having a central axis defining a forward and a rearward direction;

a roller race having a central axis coincident with that of the shaft and a frustoconical outer surface tapering radially outward in the axially forward direction;

a plurality of frustoconically tapered rollers each having a large end and a small end and being arranged about said outer surface with the small ends of said rollers facing forward so that the surface portion of each roller furthest from the central axis of the roller race is generally parallel to said central axis;

a roller cage having a plurality of slots, said roller cage circumscribing and being spaced apart from the roller race so that said slots and said roller race together define a plurality of cavities for receiving individual rollers;

a roller pusher having (1) a forward extension for directly engaging the rear surfaces of individual rollers when the pusher is moved forwardly relative to the roller race to push the rollers forward and cause the rollers to translate radially outward along the tapered surface of the roller race within the cavities defined by the roller cage, and (2) a lip for directly engaging the roller cage when the pusher is moved rearwardly relative to the roller race to draw the rollers rearward and allow the rollers to translate radially inward;

means for biasing said roller pusher in said forward direction with a chosen force so that the force exerted upon said internal surface of said hole remains constant over a range of sizes of said hole; and means for retracting the roller pusher when the axial force is reduced to draw the roller cage rearwardly so that the rollers move radially inward and the tool can be withdrawn from the workpiece.

2. The burnishing tool of claim 1 wherein said chosen force applying means includes a hydraulic cylinder operably coupled to said roller pusher.

3. The burnishing tool of claim 1 further comprising a cutting tool mounted forward and coaxially of said burnishing tool.

4. A cylindrical hole burnishing tool comprising:

a drive shaft having a drive axis defining a forward and a rearward direction;

a roller bearing race drivably coupled to said drive shaft, said race having a frustoconical outer bearing surface tapering radially outward in the axially forward direction;

a plurality of frustoconically tapered roller bearings each having a large end and a small end;

cage means for loosely capturing said roller bearings for rolling engagement against said bearing surface, said roller bearings arranged with their large ends facing rearward and their small ends facing forward so that the portions of said roller bearings furthest from the bearing surface generally lie along an imaginary cylindrical surface coaxial with said drive axis, said cage means adapted to allow said roller bearings some radial movement;

a roller pusher having (1) a forward extension for directly engaging the rear surfaces of individual rollers when the pusher is moved forwardly relative to the roller race to push the rollers forward and cause the rollers to translate radially outward along the tapered surface of the roller race within the cavities defined by the roller cage, and (2) a lip for directly engaging the roller cage when the pusher is moved rearwardly relative to the roller race to draw the rollers rearward and allow the rollers to translate radially inward;

means for biasing said roller pusher in said forward direction with a first force so that said burnishing tool is rotatably advanced into said cylindrical hole in said forward direction, said roller bearings being engaged directly by the roller pusher so that they contact the internal surface of said cylindrical hole with a generally constant second force even as the diameter of said cylindrical hole varies over a range of diameters; and means for retracting the roller pusher when the axial force is reduced to draw the roller cage rearwardly so that the rollers move radially inward and the tool can be withdrawn from the workpiece.

5. The burnishing tool of claim 4 further comprising:

means extending radially from said drive shaft for radially supporting said drive shaft within said cylindrical hole when said roller bearings are forced rearwardly, said radial support means contacting the internal surface of said cylindrical hole so that said roller bearings do not score said internal surface when said burnishing tool is removed from said hole.

6. The tool of claim 4 wherein the retracting means includes a spring.

7. The tool of claim 4 and additionally comprising radially extending pads engaging the interior of the cylinder when the rollers are retracted to facilitate removal of the tool from the workpiece.

8. The tool of claim 4 wherein the roller race is nonrotatably coupled to a drive shaft.

9. The tool of claim 4 wherein the biasing means includes a fluid actuated piston, and a plurality of dowel pins for coupling the piston to the roller pusher, said dowel pins resting against the piston but not attached thereto whereby the piston force is equally distributed across the roller pusher.

10. The tool of claim 9 wherein the piston is free floating.

11. The tool of claim 9 wherein the fluid is a hydraulic fluid.

* * * * *